US007296436B2

(12) United States Patent
Dekiya

(10) Patent No.: US 7,296,436 B2
(45) Date of Patent: Nov. 20, 2007

(54) CRYOREFRIGERATOR CONTAMINANT REMOVAL

(75) Inventor: Isamu Dekiya, Schaumberg, IL (US)

(73) Assignees: Sumitomo Heavy Industries, Ltd., Tokyo (JP); SHI APD Cryogenics Inc., Allentown, PA (US)

( * ) Notice: Subject to any disclaimer, the term of this patent is extended or adjusted under 35 U.S.C. 154(b) by 277 days.

(21) Appl. No.: 10/859,429

(22) Filed: Jun. 2, 2004

(65) Prior Publication Data

US 2005/0268641 A1 Dec. 8, 2005

(51) Int. Cl.
*F25B 43/04* (2006.01)

(52) U.S. Cl. ..... 62/468

(58) Field of Classification Search ..... 62/468, 62/6, 84, 467
See application file for complete search history.

(56) References Cited

U.S. PATENT DOCUMENTS 3,274,789 A * 9/1966 Mitchell ..... 62/85
4,441,330 A * 4/1984 Lower et al. ..... 62/149
5,232,588 A * 8/1993 Gryder ..... 210/168
5,481,879 A 1/1996 Asami et al.
6,336,331 B1 * 1/2002 White et al. ..... 62/48.2
6,488,120 B1 * 12/2002 Longsworth ..... 184/6.17
7,076,960 B2 * 7/2006 Takemasa ..... 62/6

OTHER PUBLICATIONS

Longsworth, R.C., Helium compressor for GM and pulse-tube expanders, 2002, Advances in Cryogenic Engineering: Proceedings of the Cryogenic Engineering Conference, vol. 47, pp. 691-698.*

* cited by examiner

*Primary Examiner*—Melvin Jones
(74) *Attorney, Agent, or Firm*—Katten Muchin Rosenman LLP

(57) ABSTRACT

Disclosed is a method of removing contaminants from a GM type cryogenic refrigerator that incorporates an oil lubricated compressor where such contaminants are introduced during servicing the refrigerator where at least some of the oil is replaced with clean oil.

6 Claims, 1 Drawing Sheet

CRYOREFRIGERATOR CONTAMINANT REMOVAL

BACKGROUND OF THE INVENTION

The present invention relates to cryogenic refrigerators, in particular pulse tube refrigerators, Gifford McMahon (GM) refrigerators, and Solvay refrigerators, that use air conditioning type oil lubricated compressors. These refrigerators consist of an expander, sometimes referred to as a coldhead, which is connected to a remote compressor by supply and return gas lines. Such systems are in widespread use in cooling MRI magnets and cryopumps. These refrigerators have expanders that run at low speed, relative to the compressor, and are thus able to produce refrigeration efficiently at temperatures in the range of 4 K to 20 K. Oil in the compressor is typically removed from the helium working fluid in an oil separator that returns oil to the compressor, followed by an adsorber that is replaced at intervals of about 18 months While manufacturing procedures have been developed that assure that the helium is clean enough so that new refrigerators run at stable temperatures for a long period of time, it has been found that contaminants are sometimes introduced during service. This can cause the operating temperature to rise. When this happens it has been found to be very difficult to remove these contaminants in the field, and it is customary to replace the compressor to restore acceptable operation.

A method of returning a refrigerator to acceptable operation after it has become contaminated has been discovered and is the object of this invention.

SUMMARY OF THE INVENTION

After a 4 K GM type refrigerator has been serviced there is sometimes a slow rise in temperature due to the accumulation of contaminants in the expander. Servicing the expander involves removal of the gas lines, venting helium as the expander warms, removing the drive assembly, replacing seals, reassembly, purging with clean helium, reconnecting the gas lines, and restarting the refrigerator. The gas lines that connect the expander to the compressor typically have self-sealing couplings which usually only allow a trace amount of air to mix with the helium when they are connected. Occasionally, worn couplings allow an excess amount of air to mix with the helium. The contaminants eventually freeze out in the expander. The contaminants in the expander can be removed by disconnecting the gas lines while the expander is cold, connecting vent valves, then allowing the expander to warm up and vent the trapped gas as it expands. A purge with clean helium removes the balance of the contaminants from the expander. The compressor can also be purged with clean helium, but this doesn't always remove enough of the remaining contaminants to prevent a repetition of having contaminants collect in the expander again, and cause the cold temperature to slowly rise.

Rather than solving the problem by replacing the compressor it has been found that the problem can be solved by first isolating the expander, warming it, and purging it with high purity helium, then replacing the oil in the compressor with clean oil. This can be done at the customer site, thus saving considerable expense.

DESCRIPTION OF PREFERRED EMBODIMENT

Figure 1:
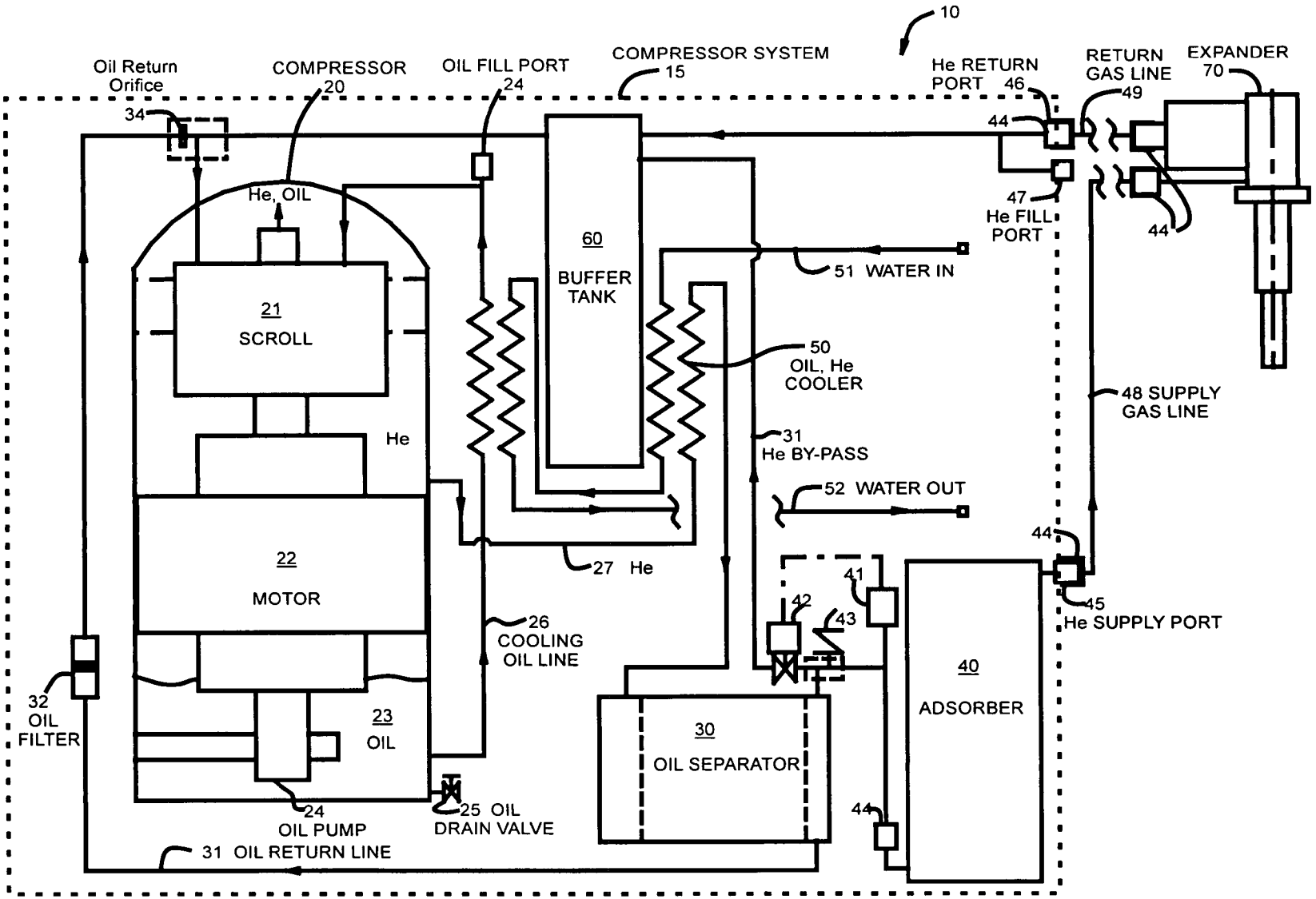
FIG. 1 is a schematic of a GM refrigerator that is in wide spread use cooling MRI magnets. Ports for filling and draining oil from the compressor are shown.

GM cycle refrigerators have enabled refrigeration to be produced at very low temperatures with high reliability, long life, and moderate cost, by utilizing oil lubricated air-conditioning type compressors. This has been made possible by using an oil with a very low vapor pressure, e.g. Union Carbide LB 100X, vacuum baking it to remove contaminants, and knowing how to remove oil that is entrained in the helium as it leaves the compressor.

FIG. 1 is a schematic of a GM refrigerator 10 consisting of an expander 70, a supply gas line 48, a return gas line 49, and a compressor system 15. A description of the expander that is in the present 4 K GM refrigerators, which are being used to cool MRI magnets, is contained in U.S. Pat. No. 5,481,879. The gas lines are typically flexible SS bellows type lines with Aeroquip® self sealing couplings 44 on the ends. The compressor system described herein is model CSW-71 manufactured by Sumitomo Heavy Industries. U.S. Pat. No. 6,488,120 describes a compressor with many similar features.

The main components in compressor system 15 are the compressor 20, an oil separator 30, an adsorber 40, an oil/helium cooler 50, and a buffer tank 60. Helium returns from expander 70 at low pressure, e.g. 0.7 MPa, through gas line 49, which is connected to compressor system 10 at return port 45. Helium then flows through buffer tank 60 to the inlet of compressor 20. Buffer tank 60 is in the system to smooth out the pressure pulses that result from expander 70 operating at about 1 Hz and compressor 20 operating at 50 or 60 Hz. Some compressors have the housing at low pressure which serves as a buffer tank but the compressor shown is a scroll type compressor that has the low pressure helium enter directly into scroll 21. Scroll 21 is driven by electric motor 22.

Oil in line 26 that has been cooled in 50 is also injected into the scroll where it is mixed with the helium as both the helium and oil are compressed. The mixture is discharged from the center of the scroll, and the bulk of the oil separates from the helium and collects in the bottom of the compressor, 23.

Helium at high pressure, e.g. 2.1 MPa, flows through line 27 and cooler 50, then into oil separator 30. Oil that is separated from helium in separator 30 is returned to the compressor inlet through line 31, filter 32, and orifice 43. Helium leaving separator 30 flows into a manifold that contains atmospheric relief valve 43, pressure sensor 41, and solenoid valve 42. A controller, not shown, opens valve 42 when sensor 41 indicates an upper pressure limit has been reached, Gas that would normally flow through adsorber 40, supply port 45, and gas line 48, to expander 70, is by-passed back to buffer tank 60. The helium and oil are cooled in 50 by water flow in through line 51 and out through line 52. Helium is added to the system through fill port 47. Oil can be added to the system through fill port 24 and drained through port 25.

Oil separator 30 is very efficient but it does allow approximately 100 mL/yr of oil to pass into adsorber 40. The adsorber can hold a minimum of 800 mL but because of the seriousness of having oil get into expander 70 it is recommended that adsorber 40 be replaced at two year intervals.

Self-sealing couplings 44 on the inlet and outlet of the adsorber make it practical to replace the adsorber at the user site. Oil is also added to compressor 20 to make up for the oil that is removed in adsorber 40. Routine service at two year intervals also includes stopping expander 70, warming it to room temperature, removing gas lines 48 and 49 at the expander, venting the gas from the expander, taking it apart to service the piston rings and valve disc, reassembly of the expander, connecting a helium supply bottle, purging air from the expander, then replacing the service gas fittings with gas lines 48 and 49.

Under normal circumstances, service is performed without introducing contaminants into the helium circuit. If however, air does get into the system and mixes with the helium it has been found to be relatively easy to remove all of the components in air, except water. The lubricating oil is very hydroscopic, and only releases water at a fast rate when it is heated to about 300 C. Near room temperature water evolves from the oil over a period of many months. The collection of water in the expander is the primary cause of the expander temperature rising after other contaminants have been removed.

The present invention is based on the observation that replacing the oil in compressor 20 returns a system, which is contaminated with water, to its original operating condition.

Although the following is not intended as an explanation as to the working of the process, it is postulated that the system functions in the following manner.

The CSW-71 compressor system is charged with about 3.8 L of oil that has been vacuum baked. Of this amount, about 1 L saturates the oil separator. The balance is distributed between compressor 20, mostly in the bottom, 23, and oil cooler 50. Oil cooler 50 is constructed such that oil drains out of cooler 50 and returns to the bottom of the compressor, 23. It is thus possible to drain as much as 3 L of oil from the compressor through drain valve 25. If it is assumed that vacuum baking the oil leaves about 30 ppm of water in the oil, and the expander can tolerate as much as 50 ppm of water in the oil, then it is calculated that the oil in the separator, that can't be removed, can have as much as 125 ppm water, to end up with an average of 50 ppm after the oil in the system becomes mixed. Of course, where the fresh oil has a water content of less than 30 ppm, less oil has to be drained, or a higher contamination level can be accommodated, or both.

It is unlikely that a problem with servicing a system would introduce such a high level of contamination and that the procedure of replacing the oil, to reduce the level of contamination to an acceptable level, will work with systems that can't replace as high a fraction of the oil as the CSW-71.

In a second embodiment of the invention the partial oil drain and refill process can be reiterated one or more times to gradually diminish the contaminant load in the oil. This multiple drain-refill procedure is useful in those systems where it is impossible or impracticable to remove as much oil as necessary in a single drain-refill operation. As much oil as possible is replaced, after which the compressor may be run with the gas lines disconnected until the contaminants are uniformly mixed with the oil. A portion of the oil is then again replaced.

While this procedure has immediate application to the present 4 K GM refrigerator made by Sumitomo Heavy Industry, it can be used with any GM refrigerator with an oil lubricated compressor that is contaminated. Most systems have an oil fill port so that oil can be added after the adsorber is replaced. This can be used to drain oil by tipping the compressor on its side.

No current systems have been found to have oil drain valves. New systems designed in accordance with this invention have an oil drain port to facilitate oil removal and replacement. While it has been found possible to drain about 40% of the oil from the system through the oil fill port, when an oil drain port is installed the amount capable of being removed almost doubles.

The CSW-71 compressor described above represents a preferred embodiment of the present invention because a) it has an oil cooler that drains back into compressor when the system is turned off, b) it has an oil fill port for adding oil, c) it has an oil drain valve at the bottom of the compressor for removing oil, and d) a high fraction of the oil, up to about 79% can be drained and replaced. Other similar compressors can be substituted fro the CSW-71 compressor of the preferred embodiment provided they have at least one of an oil filler port and an oil drain port.

The invention claimed is:

1. A method of removing contaminants from a GM, pulse tube or Solvay type cryogenic refrigerator that incorporates an oil lubricated compressor comprising replacing at least some of the oil in the compressor with clean oil wherein the contaminant is water and where an expander is disconnected from the compressor during servicing.

2. A method of removing contaminants from a GM, pulse tube or Solvay type cryogenic refrigerator that incorporates an oil lubricated compressor comprising replacing at least some of the oil in the compressor with clean oil wherein the contaminant is water and sufficient oil in the system is replaced with sufficient clean oil containing less than 50 ppm water to provide an average water content in the oil in the system of no more than 50 ppm.

3. A method of removing contaminants from a GM, pulse tube or Solvay type cryogenic refrigerator that incorporates an oil lubricated compressor comprising replacing at least some of the oil in the compressor with clean oil wherein the contaminant is water and sufficient oil in the system is replaced with sufficient clean oil containing less than 50 ppm water to provide an average water content in the oil in the system of no more than 50 ppm and wherein the clean oil has a water content of about 30 ppm.

4. A method of removing contaminants from a GM, pulse tube or Solvay type cryogenic refrigerator that incorporates an oil lubricated compressor comprising replacing at least some of the oil in the compressor with clean oil wherein the contaminant is water and sufficient oil in the system is replaced with sufficient clean oil containing less than 50 ppm water to provide an average water content in the oil in the system of no more than 50 ppm and the clean oil has a water content of less than 30 ppm.

5. A method of removing contaminants from a GM, pulse tube or Solvay type cryogenic refrigerator that incorporates an oil lubricated compressor comprising replacing at least some of the oil in the compressor with clean oil wherein the contaminant is water and at least 25% of the oil in the system is replaced.

6. A GM type cryogenic refrigerator system comprising an oil lubricated compressor wherein the compressor contains an oil fill port positioned such that at least 25% of the oil can be drained and further comprising an oil cooler in which oil in the oil cooler drains back into the compressor when the system is turned off.

* * * * *